United States Patent [19]

Haglof

[11] 4,244,571

[45] Jan. 13, 1981

[54] BASEBALL GAME APPARATUS

[76] Inventor: Robert W. Haglof, 1433 Superior Ave., No. 277, Newport Beach, Calif. 92660

[21] Appl. No.: 28,048

[22] Filed: Apr. 9, 1979

[51] Int. Cl.[3] ..... A63F 7/06

[52] U.S. Cl. ..... 273/93 R

[58] Field of Search ..... 273/93 R, 93 C, 259, 273/244, 277

[56] References Cited

U.S. PATENT DOCUMENTS

| | | | |
|---|---|---|---|
| 307,402 | 10/1884 | Lynch | 273/93 R |
| 682,041 | 9/1901 | Crowe | 273/93 R |
| 726,062 | 4/1903 | Honeck | 273/93 R |
| 1,517,433 | 12/1924 | Kelly | 273/93 R |
| 1,668,818 | 5/1928 | Neale, Jr. et al. | 273/93 R X |
| 2,490,737 | 12/1949 | Muthart | 273/93 C |

*Primary Examiner*—George J. Marlo

*Attorney, Agent, or Firm*—Francis X. LoJacono

[57] ABSTRACT

A game apparatus comprising a game board representing a baseball diamond and having printed thereon a box-shaped playing field, including four delineated squares indicating first base, second base, third base, and home plate, and further having a scoreboard imprinted thereon, the game board being formed from a plastic material to allow the easy removal of markings applied during play thereof. There is a pair of dice wherein the markings O,O,S,S,T and HR are provided on the six faces of one die and the markings O,O,O,D,S and [S] are provided on the six faces of the other die, to indicate singles, doubles, triples, home runs, and outs—the four playing pieces representing base runners are positioned on the bases according to the play of dice, and wherein score is kept on a scoresheet having delineated areas for players' names and score boxes for each corresponding player.

1 Claim, 8 Drawing Figures

FIG. 1
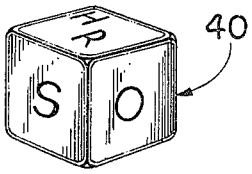
FIG. 3
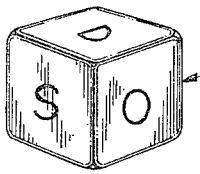
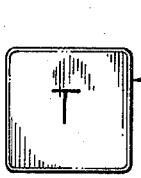
FIG. 2
FIG. 4
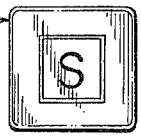
FIG. 5
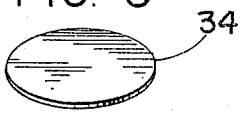
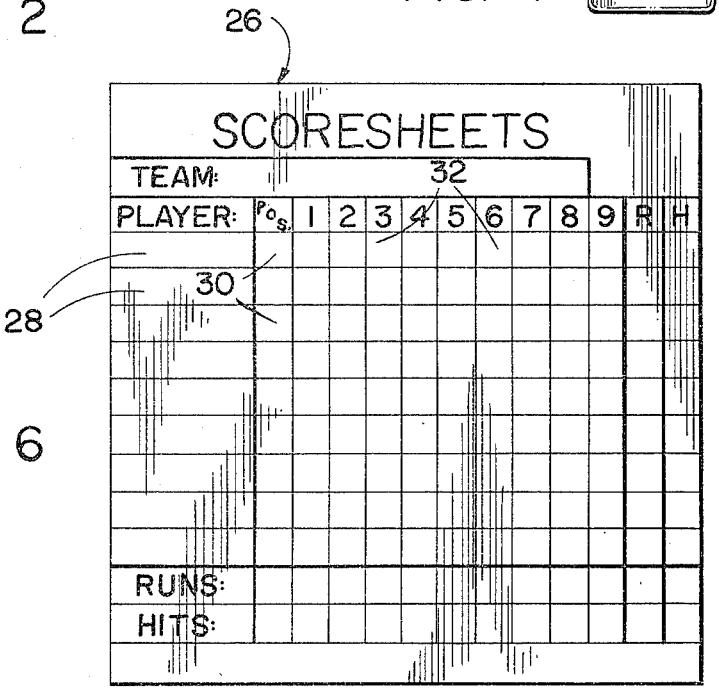
FIG. 6
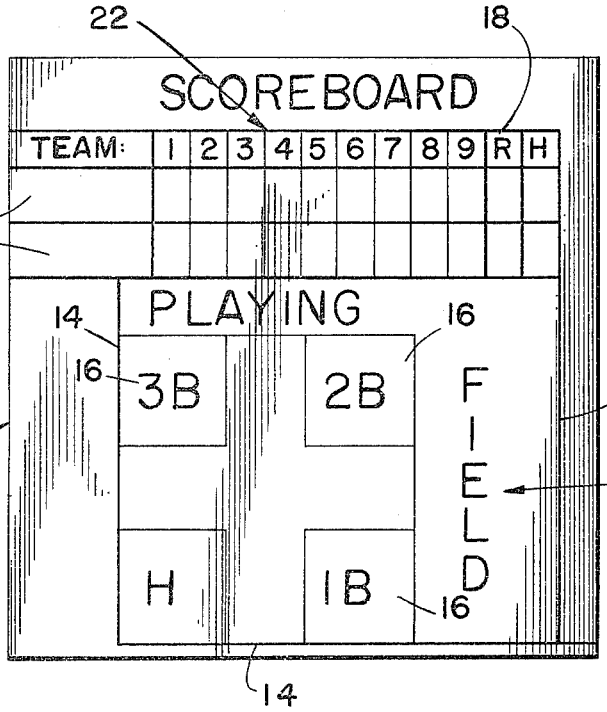
FIG. 7
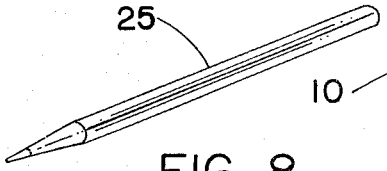
FIG. 8

BASEBALL GAME APPARATUS

BACKGROUND OF THE INVENTION

This invention relates to a game apparatus, and more particularly to a game that allows one or two persons to play nine innings of baseball—the game board being arranged to represent the players' favorite teams.

Various types of games and game-board apparatuses have been provided, and each of these apparatuses has its own unique arrangement, configurations and rules. Some of these games require several players, and some are devised for use by children or by adults.

The applicant has found that there is a need for a game corresponding to baseball, whereby the names of known ball teams and their associated players can be represented, and also changed for each game played—thus providing a more personal and realistic atmosphere for each particular game.

SUMMARY AND OBJECTS OF THE INVENTION

The present invention comprises a game board having a baseball diamond and field of play printed thereon. The diamond is defined by a boxed area indicating the infield and having marked boxes for first base, second base, third base and home plate—four playing pieces being used to represent various players at bat, or on base, as the game is played. A scoreboard is additionally provided and printed on the playing card which is made from a sheet of plastic that can be marked with a felt-tip pen or a crayon-type pencil which is readily erasable from the scoreboard after each game is played.

Also included is a scoresheet that can be printed on paper sheets so as to keep permanent records of each game; or it, too, can be made from a plastic material for ease in erasing for the next game to be played.

The game is played with two dice members wherein each is marked with various letters representing the various hits, runs, and outs—providing a means of determining the movements of the game pieces that represent runners on base or at bat.

Thus, it is an important object of the invention to provide a baseball-oriented game that allows one or two players to choose their favorite team or teams to be entered in the game play, and wherein a full nine-innings game can be played within five to ten minutes.

Another object of the game is to allow the players to compute realistic individual and team-batting averages, runs batted-in, and so on.

Still, another object of the invention is to provide a baseball game of this character that can be readily played by anyone—young and old alike—who has a particular interest in the game of baseball.

It is still a further object of the present invention to provide a game of this type that is relatively inexpensive to manufacture and to use.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of one of the dice members showing the arranged markings thereon;

FIG. 2 is a side-elevational view of the dice member showing another marking not seen in FIG. 1;

FIG. 3 is a perspective view of the second dice member showing showing various letters representing game plays;

FIG. 4 is a side-elevational view thereof showing a marking not seen in FIG. 3;

FIG. 5 is a perspective view of one of the four game pieces that represent runners;

FIG. 6 is a plan view of the printed scoresheet having spaces for marking the team and its players;

FIG. 7 is a plan view of the scoreboard with the playing field illustrated thereon; and FIG. 8 is a perspective view of a marking device.

DESCRIPTION OF THE PREFERRED EMBODIMENT

Referring now to the drawings and more particularly to FIG. 7, there is illustrated a game board, generally indicated at 10, having formed on a portion of the face thereof a playing field, designated at 12. The playing-field area is defined by an enlarged boxed area formed within marked-off lines 14. Further formed or printed within the playing field 12 are four delineated smaller square boxes 16 arranged to form a baseball diamond wherein boxes 16 designate bases. The first box is marked "H" and represents home plate, the second box is marked "1B" and represents first base, the third box designates second base and is marked "2B", and the last box is marked "3B"—thus completing the typical layout of a baseball diamond.

In addition thereto, a scoreboard 18 is formed on the surface of the game board and is arranged in a typical manner having two boxed areas 20, whereby the player or players of the game can insert the names of any two baseball teams that might be chosen in any given game play. As an example, one can insert the name of the California Angels in one box and the New York Yankees in the other box. A plurality of smaller boxed segments 22 are arranged to indicate the innings of play, and the runs and hits.

It is contemplated that various types of materials can be employed in forming the game board 10, such as hard paper-back printed sheets or base-board material having a decal mounted thereon so as to be capable of being marked by a felt-tip pen or a crayon-type pencil 25, shown in FIG. 8. There are many known types of marking devices that can be readily removed from the playing-board surface by wiping with a damp cloth.

Thus, the scoreboard can be changed for each game played, thereby allowing the same game board to be continuously used.

In FIG. 6, there is illustrated a scoresheet, generally indicated at 26, having a plurality of boxes 28 formed thereon wherein the names of the individual players of the selected team are inserted. These boxes are aligned vertically under the heading of "PLAYER". Additional boxes 30 are aligned to indicate the positions of the players, followed by boxes 32 marked 1 through 9 for the innings of play. Further, boxes are provided to indicate runs and hits. It is contemplated that the scoresheets will be printed on paper sheets forming a pad of scoresheets, whereby records can be kept of each game and whereby the players of the games can formulate batting averages for each indicated team member.

The game is provided with four game pieces 34 which represent base runners. Thus, as the game is played, a game piece controlled by a specially marked pair of dice (indicated in FIGS. 1 through 4) will be positioned on the base according to game play.

One particularly marked dice is shown in FIGS. 1 and 2, generally indicated at 40, forming a typical six-sided square cube whereon "O" is marked on two sides thereof, with the remaining four sides being respectively marked "S", "S", "T" and "HR"—"O" indicating an out, "S" indicating a single, "T" representing a triple, and "HR" representing a home run. The second dice 40*a* is provided with three markings of "O" for out, "D" for double, "S" for single, and [S] for a single plus, which will be hereinafter described in the operation of the game.

The above indicated markings of each dice are designed to give a realistic score so as to provide realistic statistics for computing batting averages of approximately 0.333.

Accordingly, the dice are arranged to provide the following possible plays:

| REGULAR RULES | ALTERNATIVE RULES |
|---|---|
| Nine (9) possible singles | Eight (8) possible singles |
| Two (2) possible doubles | Two (2) possible doubles |
| One (1) possible home run | One (1) possible triple |
| | One (1) possible home run |

Under the regular rules, the game is played by 1 or 2 players, each designating a team and its team members. The dice are rolled by a player until three outs are rolled. Play is determined by the arrangement of the two dice wherein the lowest play indicated is used. That is, when at least one dice shows an "O", this would indicate an out. When an "S" is indicated on one dice and the other indicates a higher play, it would be a single—and a base runner would be placed on base 16. Hence, the following arrangement of the dice would indicate nine possible singles:

| | | |
|---|---|---|
| HR - S | D - S | S - [S] |
| T - [S] | D - [S] | S - S |
| T - S | S - [S] | S - S |

The two possible doubles are:

T-D and HR-D

The one possible home run is:

HR with [S]

As can be seen, there are no triples played under the regular game rules. However, the alternative rules allow a triple when the following occurs:

T with [S]

It should be further noted that—in order to have a realistic score—"T" and "HR" are located on one dice, and "D" and "[S]" are located on the other.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A game apparatus adapted to provide the characteristics of baseball, comprising:

a game board having a playing field and a simulated baseball diamond indicated thereon;

a scoreboard disposed adjacent said playing field to provide a means to keep an inning-to-inning score between two defined teams selected by the players thereof;

a plurality of game pieces defining base runners which are positioned on the baseball diamond during game play;

a pair of dice members specifically marked to provide game plays having outs, singles, doubles, triples and home runs defined by markings O, O, S, S, T and HR on one die, the other die being marked O, O, O, D, S and [S], whereby the arrangement of the marked dice to each other establishes the location of the game pieces on the game board and gives realistic batting averages for the indicated team players; and at least one score sheet arranged to indicate the teams playing, the players of said teams, and game play of each player for each inning thereof.

* * * * *